United States Patent [19]

Monvoisin et al.

[11] Patent Number: 4,862,188

[45] Date of Patent: Aug. 29, 1989

[54] MICROWAVE ANTENNA OF LIGHT WEIGHT AND SMALL BULK

[75] Inventors: Jacques Monvoisin, Argenteuil; Valdo Trubett, Poissy, both of France

[73] Assignee: Thomson-CSF, Paris, France

[21] Appl. No.: 65,290

[22] Filed: Jun. 22, 1987

[30] Foreign Application Priority Data

Jun. 24, 1986 [FR] France ..... 86 09104

[51] Int. Cl.[4] ..... H01Q 19/12

[52] U.S. Cl. ..... 343/840; 343/912; 343/915

[58] Field of Search ..... 343/840, 912, 915, 916

[56] References Cited

U.S. PATENT DOCUMENTS

| | | | |
|---|---|---|---|
| 2,423,648 | 7/1947 | Hansell | 343/840 |
| 2,703,842 | 3/1955 | Lewis | 343/840 |
| 3,383,693 | 5/1968 | Kahn et al. | 343/915 |
| 3,964,071 | 6/1976 | Townes et al. | 343/840 |
| 4,439,774 | 3/1984 | Johnson | 343/912 |

*Primary Examiner*—Rolf Hille
*Assistant Examiner*—Hoanganh Le
*Attorney, Agent, or Firm*—Marmorek, Guttman & Rubenstein

[57] ABSTRACT

In a microwave antenna of light weight and small bulk consisting of a reflector and a mirror, the reflector is constructed of vertical combs, horizontal combs and oblique combs. The vertical combs have a pseudo-random distribution with respect to a central comb. The reflector structure has both a shaping function and a supporting function.

9 Claims, 3 Drawing Sheets

MICROWAVE ANTENNA OF LIGHT WEIGHT AND SMALL BULK

BACKGROUND OF THE INVENTION

1. Field of the Invention

This invention relates to a microwave antenna of light weight and small bulk.

2. Description of the Prior Art

Microwave antennas are usually equipped with a reflector having a structure of predetermined shape on which is placed a mirror for reflecting microwaves. The structure and the mirror are supported by a frame mainly formed of tubes welded together or of welded or riveted compartments.

It is now becoming an increasingly widespread practice to construct mirrors of laminated material when they are intended to be used for small-size radar antennas. These mirrors are formed of metallic elements such as latticework elements or expanded metal plate elements for medium and large size radars.

The reflector is made up of vertical plates which are usually referred-to as combs. These plates are attached to the structure by means of brackets and are interconnected by means of so-called Lisse tubes. Whether the mirror is formed of laminated panels, of a latticework structure or of expanded metal, said mirror is mechanically fixed on the combs by means of springs and is mechanically fixed by means of swivel joints on the Lisse tubes which connect the combs to each other.

As the antenna span is longer, so the antenna has greater sensitivity to environmental stresses, either during transportation or when vibrations occur during operation or simply in the presence of wind.

The dimensions of each antenna element are therefore predetermined so as to ensure a sufficient degree of rigidity to enable the antenna to withstand the stresses arising from its environment. The structural framework therefore has the double function of supporting the reflector and the mirror and also of contributing to the rigidity of the reflector structure. As the overall dimensions of the antenna are increased to meet these requirements, so the weight and bulk of the structural framework will consequently be greater.

In order to overcome these disadvantages, the present invention proposes a microwave antenna having a reflector structure which is inherently sufficient to carry out both the supporting function usually provided by a structural framework and the function of conformal shaping of the mirror which has been placed on said reflector, these functions being performed without producing any disturbance in the wave-propagating action of the antenna. The reflector is therefore endowed with a sufficient degree of rigidity to avoid the use of a supporting structure.

SUMMARY OF THE INVENTION

The present invention is accordingly directed to a microwave antenna provided with a reflector having a shaping structure and a reflecting mirror which is placed against the structure, provision being made for combs which intersect at different points of attachment so as to form a lattice arrangement, each frontal profile of the combs being such as to form a predetermined curve which is capable of imparting the requisite shape to the mirror. The distinctive feature of the invention lies in the fact that provision is made for a central comb and that the vertical combs are arranged in accordance with a pseudo-random law of distribution on each side of said central comb.

DESCRIPTION OF THE PREFERRED EMBODIMENTS

Figure 1:
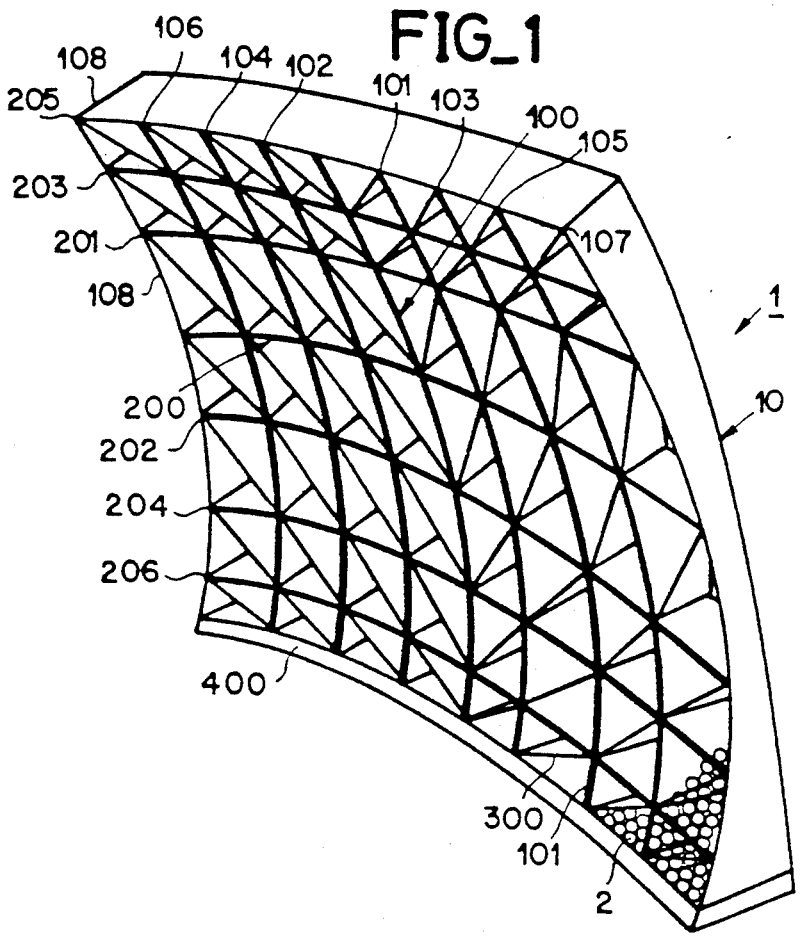
FIG. 1 is a perspective view showing a first embodiment of the antenna in accordance with the invention.

The antenna in accordance with the invention as shown in the perspective view of FIG. 1 is composed of a reflector 1 and a mirror 2. This mirror is placed on the front face of the reflector 1 but is shown only partially in the figure. The reflector is made up of metallic elements formed by flat plates which will hereinafter be designated as combs. The reflector is thus provided with vertical, horizontal and oblique combs, the number of which is determined as a function of the span of the antenna.

In order to simplify the drawings, the number of combs has been limited to nine vertical combs designated by the references 100 to 108. These vertical combs are arranged symmetrically or asymmetrically in pairs with respect to a central comb 100. The reflector is also provided with horizontal combs, only eight of which are illustrated and designated in the drawings by the references 200 to 206. The horizontal and vertical combs intersect so as to form a lattice whilst the oblique combs 300 pass through the nodes formed by the horizontal and vertical combs. The curvature of the front face of each comb forms a generator-line which serves to generate the requisite shape of the reflector, this shape being imparted to the mirror.

The dimensional qualities of the plates and the accuracy of curves in the case of each plate can be obtained by machining and cutting equipment controlled by a numerical-control machine, for example. In this particular example, the front face of each comb constitutes one of the generator-lines of a paraboloid of revolution which characterizes the shape of the mirror. Since the combs are flat plates, they do not undergo any modification of shape after cutting.

In order to achieve enhanced properties of strength and rigidity of the reflector, the vertical combs are placed on each side of a central comb with different spacing intervals. The distribution of these combs is of the pseudo-random type and complies with the mathematical law : $C=a(1+x+x^2+\ldots+x^n)$, where C is the spacing interval between the central comb 100 and each of the combs which form the sides of the antenna (that is, the half-width of the antenna) and where a is the spacing interval between the central comb 100 and the first comb 101 or 103 located on each side of said central vertical comb. The same value of a is chosen in order to obtain a symmetrical structure or two different values in order to obtain two asymmetrical structures with respect to the comb 100. This distribution permits enhanced microwave propagation performances of the reflector, these performances being related to the mechanical shape properties of said reflector. This distribution in fact makes it possible to suppress any shape defects which would be liable to appear with a distribution corresponding to equidistant spacing intervals between the vertical combs. If consideration is given to the two portions formed by the structural elements of the reflector placed on each side of the central comb 100, these two portions exhibit symmetry of shape with respect to said comb.

In the particular example shown in the drawings, the horizontal comb 400 is located in the lower portion of the reflector. By way of example, this comb can be constituted by a rigid beam formed by an assembly of two plates placed on each side of a honeycomb sheet in a sandwich assembly. It would be possible, for example, to insert the vertical combs in said beam. Interassembly of the combs is carried out either by welding or by screwing or by riveting or by adhesive bonding.

Figure 2:
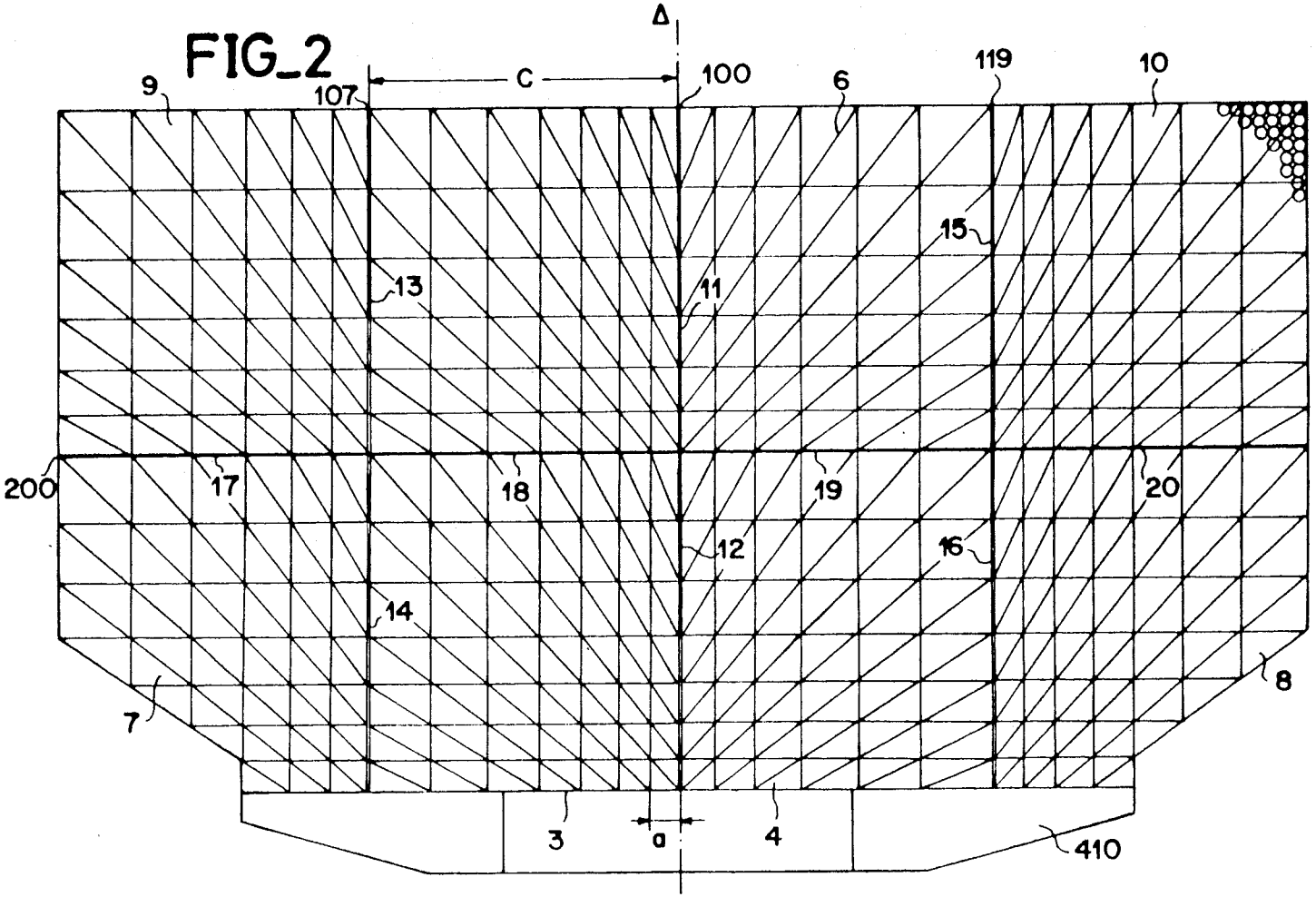
FIG. 2 is a front view showing a second embodiment of the antenna in accordance with the invention.

FIG. 2 illustrates a particular embodiment of an antenna in accordance with the invention. This figure provides a front view of an antenna constituted by an array of modules of predetermined dimensions. Each module has horizontal combs, vertical combs and oblique combs arranged with respect to each other and assembled together in the manner described in the foregoing with reference to FIG. 1. The plates forming the sides of each module are fixed. The modules are mounted so that the front face constitutes the reflector plane having the desired shape. The advantage of this arrangement is that the reflector can be disassembled for transportation and subsequently reassembled with great ease, assembly of adjacent modules being performed by screwing, for example.

The antenna in accordance with this constructional design has a central comb of symmetry which is constituted by the two combs forming one side of two modules 3 and 4 and by one side of two other modules 5 and 6, these two other modules being respectively superposed on the modules 3 and 4. The central comb 100 which is constituted by two plates in this particular embodiment therefore consists of two portions 12 and 11. If reference is made to the plane of FIG. 2 on which the antenna is projected, the modules 3 and 4 are disposed symmetrically with respect to the axis of symmetry formed by these two comb portions 12 and 11 and the modules 5 and 6 are also disposed symmetrically with respect to the portion 11. A module 7 is attached to the module 3, a module 9 is attached to the module 5, the modules 5 and 9 being superposed respectively on the modules 3 and 7. The vertical comb 107 is constituted by two plates forming one side of the module 9 and one side of the module 5 and two plates forming one side of the module 7 and one side of the module 3. This comb is therefore formed in two portions 13 and 14. Similarly, a module 8 is attached to the module 4 and a module 10 is attached to the module 6, the module 10 being superposed on the module 8. The vertical comb 119 is formed by the two plates which constitute one side of the module 6 and one side of the module 10 and two plates which constitute one side of the module 4 and one side of the module 8. This comb is therefore also formed in two portions 15 and 16. The modules 7 and 8 are disposed symmetrically with respect to the axis of symmetry, again with reference to the plane of the figure. The modules 9 and 10 are also disposed symmetrically with respect to the axis of symmetry with reference to the plane of the figure. The central horizontal comb 200 is divided into four portions 17, 18, 19 and 20. The portion 17 is constituted by the two sides which belong respectively to the module 7 and to the module 9, the portion 18 is constituted by two sides belonging respectively to the module 3 and to the module 5, the portion 19 is constituted by two sides belonging respectively to the module 4 and to the module 6 and the portion 20 is constituted respectively by two sides belonging to the module 8 and to the module 10.

A bearing member 410 is fixed in the bottom portion of each of the modules 3, 4, 7 and 8, and serves to install the antenna on the site location. The vertical combs which are all divided into two portions in the same manner as the vertical comb 100 are distributed within each module in accordance with the law mentioned earlier. In this case, however, the parameter C represents the spacing interval between two vertical combs forming the sides of one module and a represents the spacing interval between a vertical side comb and a first comb of this module. If the same spacing is chosen for all the modules, symmetry of distribution of the vertical combs is obtained in respect of the modules located on each side of the central comb. Symmetry of distribution of the vertical combs is also achieved in the case of the modules located on each side of the four central modules, this symmetry being always achieved with respect to the central comb 100. If a different value of a is chosen on each side of the central comb, the vertical combs are distributed asymmetrically, as is the case in this figure. The arrangement of the modules alone possesses symmetry with respect to the median plane.

The oblique combs in each module constitute the diagonals of each of the squares or rectangles which belong to these modules. The modules can be either squares or rectangles and their dimensions are a function of the intended height and width of the antenna. A portion of each module 7 and 8 has been suppressed in order to conform to the particular shape to be given to the reflector, these portions being located in the line of extension of an oblique comb and in the line of extension of a vertical comb. By way of example, the front ribs of the combs are paraboloid generators.

The vertical combs each constitute a beam element of equal stress.

The oblique combs ensure transverse rigidity while bringing back aerodynamic stresses in the axis of the reflector.

Figure 3:
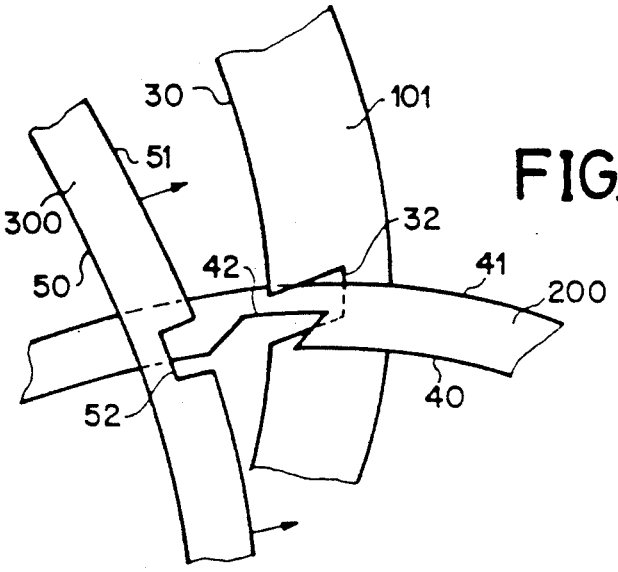
FIG. 3 illustrates details of construction.

FIG. 3 illustrates a constructional detail showing portions of combs which have been cut at the points of interengagement of these latter which accordingly form nodes. The front rib 30 of the comb 101 is provided with a series of notches 32, only one of which is shown in this fragmentary view. The front rib 40 of a horizontal comb 200 is also provided with a series of notches 42, only one of which is shown in the figure. The rear rib 51 of the oblique comb 300 is also provided with a set of notches, only one of which is shown and designated by the reference 52. At the time of assembly, the dorsal portion of the horizontal comb is fitted within the notches 32, this dorsal portion being designated by the reference 41 and the dorsal portion of the oblique comb 300 is fitted within the notches 42 and 32, this dorsal portion being designated by the reference 51. The three combs at each node can be either screwed or adhesively bonded, for example.

Figure 4:
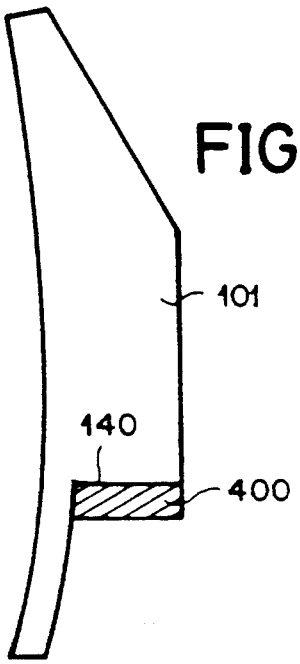
FIG. 4 is a sectional view taken along a midplane corresponding to an alternative embodiment.

FIG. 4 is a sectional view taken along a median plane and corresponding to an alternative arrangement for positioning the comb 400. In this configuration, the comb 400 is placed beneath a notch 140 of the comb 101 which is the only one to be shown in the figure. This comb 400 is therefore placed beneath the set of notches formed in each vertical comb of the structure. The vertical combs are designed in the form of rods at each lower end located beneath the comb 400. This alternative design concerns an antenna of smaller size than the antenna which is illustrated in either FIG. 1 or FIG. 2.

In a specific example, the antenna shown in the front view of FIG. 2 has a width of 9 meters and a height of 4.98 meters whilst the width of a module is 2.25 meters.

What is claimed is:

1. A microwave antenna of light weight and small bulk provided with a reflector having a shaping structure and a reflecting mirror which is placed against the structure, said structure comprising a first set of vertical combs and a second set of horizontal combs transverse thereto which combs intersect each other at different points so as to form part of a lattice arrangement, said structure further comprising a third set of oblique combs which pass through the points of intersection formed by the horizontal and vertical combs and which complete said lattice arrangement, a generator-line being formed by each front comb profile for generating the shape to be given to the mirror, wherein said structure includes a plurality of interassembled modules and wherein vertical and horizontal combs of each module respectively form a first and a second arrangement of combs, each arrangement being made according to the law of distribution:

$$C=a(1+x+x^2+\ldots+x^n)$$

where C is the size of said module, a is the smallest spacing within said arrangement between one side of a module and the first adjacent comb, x is predetermined parameter, and (n+2) is the number of combs within said arrangement.

2. A microwave antenna according to claim 1, wherein the modules are assembled together in at least one pair by screwing along a common side thereof.

3. A microwave antenna according to claim 1, wherein said antenna comprises a central comb forming an axis and is provided with a first module, a second module placed symmetrically with respect to said axis, a third module placed above the first module, a fourth module arranged symmetrically with respect to the axis and placed above the second module, a fifth module adjacent to the first module, a sixth module placed above the fifth module, a seventh module adjacent to the second module, an eighth module placed above the seventh module and adjacent to the fourth module, the seventh and eighth modules respectively being placed symmetrically with respect to the fifth and sixth modules.

4. A microwaves antenna according to claim 1, wherein the front ribs of the combs are generator-lines for generating a paraboloid of revolution.

5. A microwave antenna according to claim 1, wherein the combs are constituted by flat plates.

6. A microwave antenna according to claim 1, wherein the combs are interengaged at the points of intersection.

7. A microwave antenna according to claim 1, wherein the combs are riveted to each other at the points of intersection.

8. A microwave antenna according to claim 1, wherein the combs are welded to each other at the points of intersection.

9. A microwave antenna according to claim 1, wherein the combs are adhesively bonded to each other at the points of intersection.

* * * * *